US006471271B1

(12) United States Patent
Segal

(10) Patent No.: US 6,471,271 B1
(45) Date of Patent: Oct. 29, 2002

(54) TOOL FOR CLEANING RAIN GUTTERS

(75) Inventor: Robert A. Segal, Fox River Grove, IL (US)

(73) Assignee: Segal Manufacturing, Inc, Fox River Grove, IL (US)

( * ) Notice: Subject to any disclaimer, the term of this patent is extended or adjusted under 35 U.S.C. 154(b) by 0 days.

(21) Appl. No.: 09/967,702

(22) Filed: Oct. 1, 2001

(51) Int. Cl.[7] ..... E04D 13/076
(52) U.S. Cl. ..... 294/19.1; 15/236.04
(58) Field of Search ..... 294/19.1, 19.2, 294/22, 23, 50.8, 111; 15/236.04; 56/328.1, 332, 333

(56) References Cited

U.S. PATENT DOCUMENTS 3,972,552 A * 8/1976 Earp ..... 294/19.1
4,057,276 A * 11/1977 Currie ..... 294/19.1
4,114,938 A * 9/1978 Strader ..... 294/19.1
4,196,927 A * 4/1980 Lomaga ..... 294/19.1
5,853,209 A * 12/1998 McDermott ..... 294/19.1
5,855,402 A * 1/1999 Maraschiello ..... 294/19.1
6,139,077 A * 10/2000 Molzan ..... 294/19.1
6,209,937 B1 * 4/2001 Keiter ..... 294/19.1

* cited by examiner

*Primary Examiner*—Johnny D. Cherry
(74) *Attorney, Agent, or Firm*—Charles F. Lind

(57) ABSTRACT

The inventive tool has two elongated tongs pivoted together at corresponding ends, to have the remote tong ends gapped apart when opened and touching when closed. A spring biases the tongs to opened positions, and stops center the tongs when fully opened. A flexible tong line is connected at its ends to intermediate locations of the respective tongs and is routed as three separated spans crossing between the tongs; two tong line spans crossing from the end connections and the third or intermediate tong line span crossing closer to the pivoted ends. A flexible pull line is secured to the intermediate tong line span. With the tool carried on an extension pole, an operator can position the tong ends and tension the pull line to grip remote objects, such as gripping and removing Leaves from an overhead gutter.

12 Claims, 4 Drawing Sheets

TOOL FOR CLEANING RAIN GUTTERS

BACKGROUND OF THE INVENTION

Rain gutters commonly are mounted adjacent the horizontal edges of building roofs to collect rain water draining off the roof and carry it along generally horizontal runs to one or more generally vertical downspout(s), operable to minimize water dripping randomly off the roof edges.

A typical rain gutter is generally U-shaped, with spaced inward and outward substantially vertical side walls and a connecting horizontal bottom wall, to define an upwardly open channel. The inward side wall is secured to the building, slightly lower than or horizontally aligned with the roof line, so that water can easily drain from the roof into the gutter channel. Spaced straps or pins extend between the inward and outward side walls across the tops thereof for supporting and strengthening the gutter.

Solid debris, such as leaves, seeds, branches, etc. released from nearby plants and overlying trees, that lands on the roof can be carried by rain water, gravity, etc. to the gutter and/or downspout. As such accumulated debris can preclude proper water drainage along or from the gutter, it periodically must be cleared from the gutters. Moreover, such debris when wetted can become tangled or matted together, making the task of removal quite difficult.

Of importance to this invention, most gutters are ten feet or higher above the ground so that one can only remove the debris therein by procedures involving: (1) standing on a ground supported ladder or scaffolding; (2) by moving around on the roof; or (3) by a pole supported tool operated from the ground. The first two mentioned procedures require either the stated equipment and/or incur personal safety risks, which many homeowners realize and thus avoid. Known pole supported tools operate poorly and/or only with great effort.

Some forms of gutter cleaning tools direct air or water as jets along and into the gutter, but debris therein at best is randomly dispersed all over the underlying ground (and operator), which then must be cleaned up; while the debris at worse can become bound on gutter straps or merely be shifted along the gutter to the downspout, while yet blocking water flow from the gutter. Also, the jets frequently blow under and lift the edges of one or more of the roof shingles, potentially damaging the roof's integrity. Even having such systems supported to allow user operation from the ground, and not from the roof, has not overcome these drawbacks and/or made such tools widely accepted.

Another form of pole supported tools commonly has two gripping tongs pivoted relative to a tool body and elongated sufficiently to extend downwardly from a position overlying the gutter to within the gutter channel. The tongs are normally spring separated to an opened position and are manually moved together to a closed position by pulling a rope from below. The intended operation in concept is thus simple, namely: lower the opened tongs until against the bottom wall of the cutter, close the tongs to pinch and collect the debris therebetween, lift the closed tongs and collected debris held therebetween from the gutter, and then open the tongs and release the debris at some convenient location spaced from the gutter.

However again, known tools of this type have not achieved much success or usage, due to the tool weight, complexity and/or inefficiencies of the tongs and their actuating structures.

For example, the tool weight appears greater when carried at a pole's length away, particularly during extended use, and/or when one is attempting to accurately lower the tongs into and manipulate them along the overhead hidden gutter channel, and/or when the pole is not aligned vertically.

Accurate tool positioning along the gutter is imperative as both tongs must be placed between adjacent pairs of cross straps, and not on opposite sides of any strap which would preclude closed tongs from being lifted from the gutter. In any cleaning effort, the cross straps cannot be ignored as they are close together (between 10–30 inches apart), randomly spaced apart, and are hidden from a tool operator located below the gutter.

Existing tools having opened tongs that wobble freely relative to the tool body are difficult to use in that hidden gutter straps frequently end up between the closing tongs. A user might try to avoid this situation by moving the lowered tool along the gutter until one tong strikes a strap; but a wobbling tong masks the realization if this tong/strap impact is on the lateral or medial side of the tong, and/or makes accurate lateral positioning of the tong against both the bottom cutter wall and against and under the strap for reaching debris under the strap.

Further, many prior art designs fail to provide full and/or flush tong contact against the bottom of the gutter as they are closed against one another (to pick up needles, leaf stems, etc.), especially if the pole and/or tensioning rope are canted relative to the gutter. Also, the tong actuating structures further should close the tongs effectively, compared to forces needed on the pull rope.

Moreover, many known tools involve tong actuating mechanisms, levers or even the tongs that project as a high silhouette vertically over the tool body, which can become entangled in branches, wires or the like overlying the gutter to hinder the mobility of the tool in moving along the gutter.

SUMMARY OF THE INVENTION

The basic object of the invention is to provide a pole supported gutter cleaning tool, that is light in weight, of few parts economical to make and assemble, of low silhouette vertically above the gutter, and easy to use; and that can be accurately positioned between adjacent gutter cross straps for effectively removing debris from most locations along the gutter including under the cross straps.

The disclosed gutter cleaning tool has stops for holding the opened tongs at a set position, steady and without a wobble, for easily finding by feel any of the hidden gutter cross straps, suited to position the appropriate diverging tong laterally against the Located cross strap to underlie such strap for allowing through removal of any debris thereunder; and the tongs have facing end scoops with flat edges adapted to ride flush against the cutter bottom wall for effectively digging through and collecting the debris therebetween, and the closing tongs are free to move with independent oscillation for remaining flush against the gutter wall, even should either the pole and/or pull line be canted from the perpendicular to the gutter.

BRIEF DESCRIPTION OF THE DRAWINGS

FIG. 12, the tongs fully closed and generally centered;

FIG. 13, the tongs fully closed and canted the maximum to one side;

DESCRIPTION OF A PREFERRED EMBODIMENT OF THE INVENTION

Figure 1:
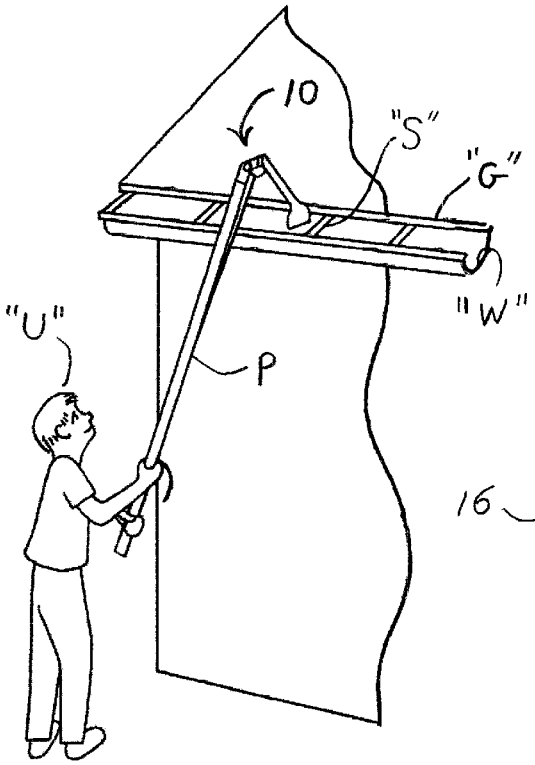
FIG. 1 is a perspective view of a person using the subject tool in cleaning an overhead gutter.

In FIG. 1, a user "U" safely standing on ground or other support surface adjacent a building is shown operating the gutter cleaning tool 10 via an extension pole "P" of any needed length to reach an overlying rain gutter "G". The cleaning tool 10 described and illustrated herein has a body 12 and a pair of gripper tongs 14, 15 mounted via structures 13 to oscillate relative to the body 12 and each other. Each tong has an elongated arm 18 extended radially from its mounting structure 13 to debris collecting end scoops 16, 17 operable to collect and trap gutter debris between them. Pull lines 19, 21 extend from the tongs to near the pole bottom, where the user can both hold the pole and tension the Lines for remote actuation of the cleaning tool.

The tool body 12 is connected across swivel connection 23 to mounting socket 25, which has a threaded bore 26 suited to be secured onto the threaded end of the extension pole "P". Nut and bolt assembly 27 provides easy swivel connection adjustment.

The mounting structures 13 include tong end plates having mated circular transverse tong faces 32, 33 and central bearing openings 35 sized to fit over and rotate on cylindrical bearing surface 37 of tool body pin 38. Lock nut 39 cooperates with threaded section 41 on tool body pin 38 to hold the tongs and tool body faces 32, 33 together, suited for relative rotation. Cooperating stops on the tool body 12 and tongs 14, 15 limit tong rotation to slightly more than one eighth of a turn each.

Figure 3:
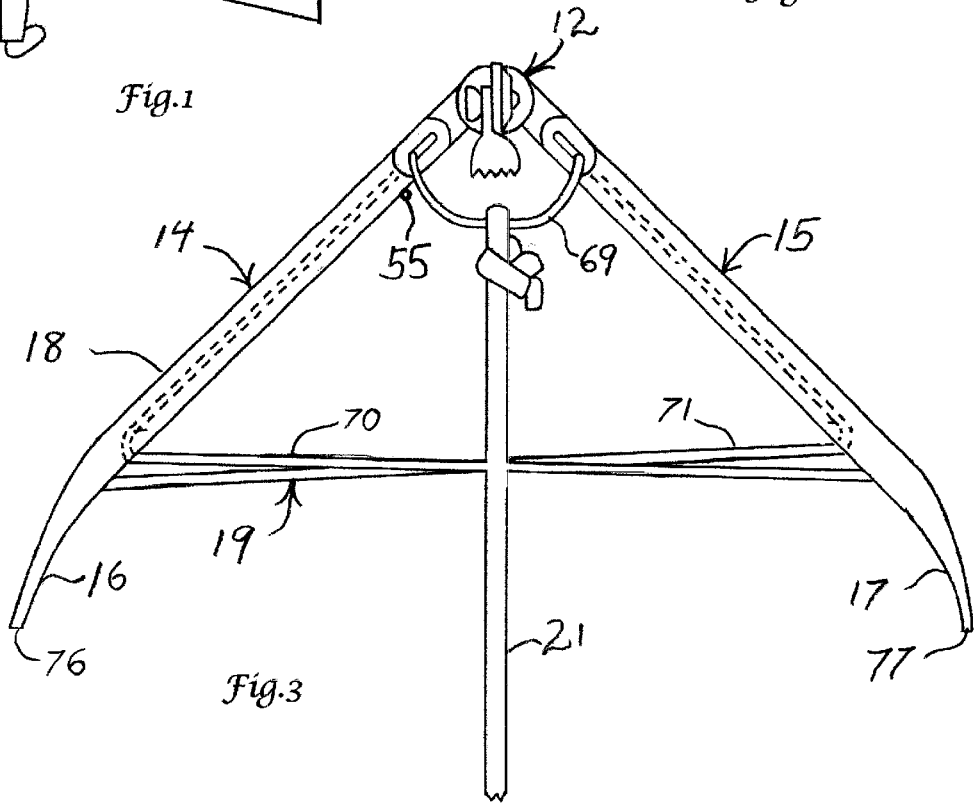
FIG. 3 is an elevational view of the opened tool as seen from the right of FIG. 2, with the pole broken away for clarity.
Figure 11:
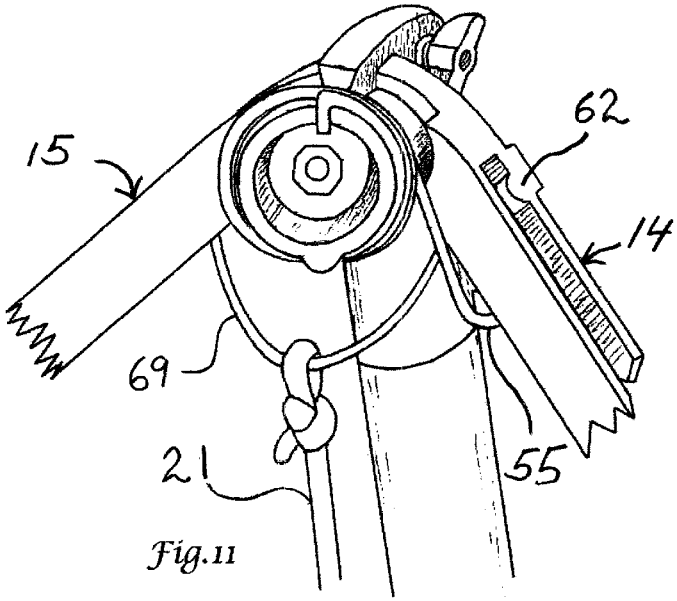

Such stops on the tongs 14, 15 respectively include radial faces 44, 45 suited to engage one side of a tool body stop 46, operable to preclude tong rotations beyond that engagement, which defines a fully opened position of the tongs (see FIGS. 3 and 11). The fully opened tongs 14, 15 are angled approximately perpendicular to one another, with the tong free end scoops 16, 17 having maximum separation from one another. The faces 44, 45 and stop 46 preferably are positioned to center the mounting socket 25 and pole "P" between the fully opened tongs; providing further that with the pole oriented vertically, the fully opened tongs diverge downwardly somewhat as an inverted "V" with the arms 18 angled approximately at 45 degrees.

Figure 13:
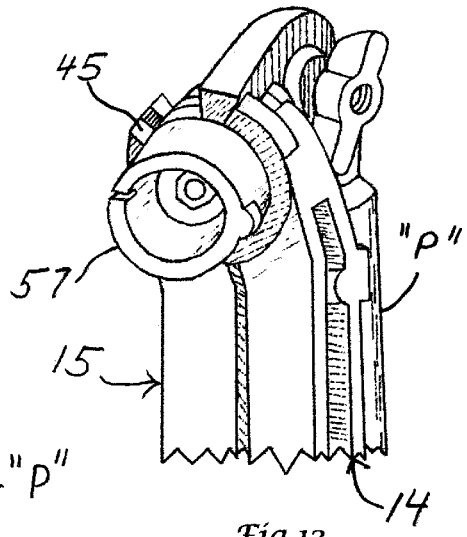

Angled approximately 90 degrees from the radial faces 44, 45, the tongs 14, 15 further have second radial faces 48, 49, which can separately engage the stop 46 when the tongs are rotated beyond the closed centered position and canted widely out of center (see FIG. 13 where the face 49 of tong 15 is against the stop 46).

Figure 8:
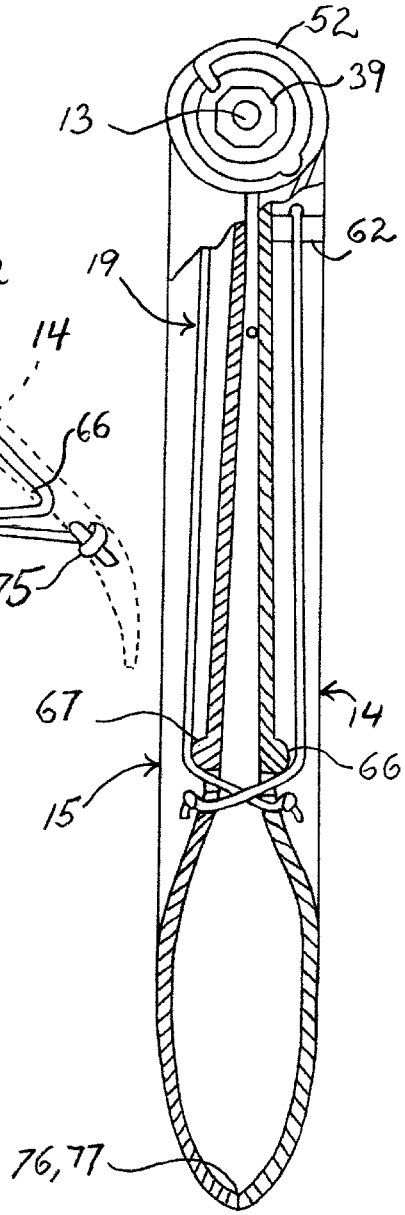
FIG. 8 is an elevational view seen from the left or gutter side of the tool of FIG. 2, but showing the tool in a fully closed position and partly in approximately centered section.
Figure 10:
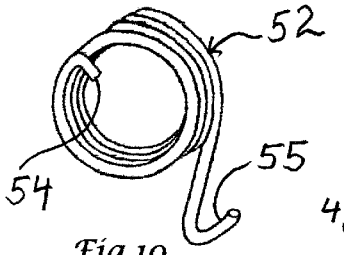
FIG. 10 is a perspective view of a spring used in the tool.
Figure 12:
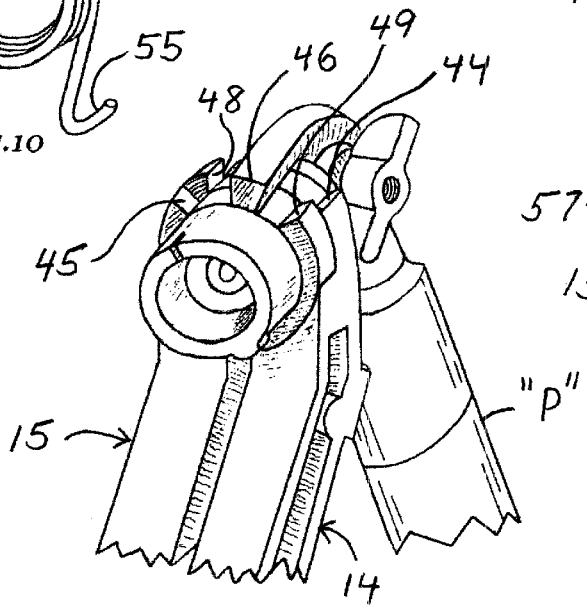
FIGS. 11, 12 and 13 are perspective views, from the gutter side, of the mounting between the tool body and tongs, specifically showing in FIG. 11, the tongs fully opened and centered.

With the tongs shifted from the fully opened position and the radial faces 44, 45, 48, 49 spaced from the stop 46, the tongs can be oscillated about the pin bearing surface 37 independently, relative to each other and the tool body. In shifting between the opened position (FIG. 3) and the closed centered position (FIGS. 8, 12), each tong will rotate approximately one eighth of a turn. The closed tongs can be rotated in unison beyond the centered position in either direction by approximately one sixteenth of a turn until either of the radial faces 48, 49 engage the stop.

Figure 4:
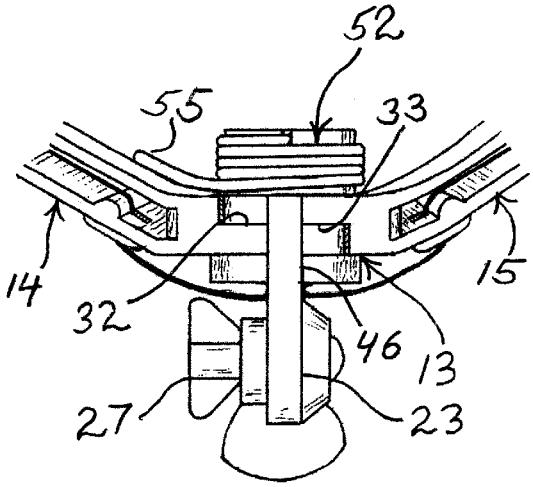
FIG. 4 is an enlarged top view of part of the FIG. 3 tool.
Figure 7:
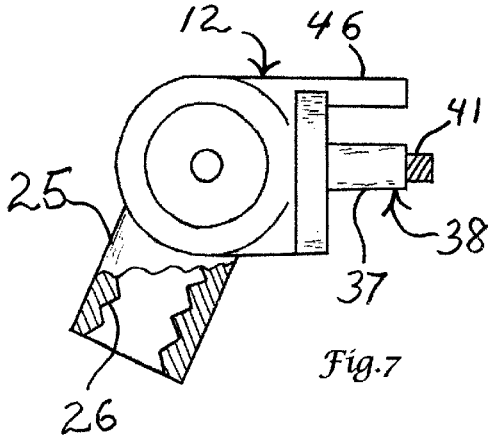
FIGS. 6 and 7 are top and side views respectively, of the tool body used in the tool of FIG. 4.
Figure 6:
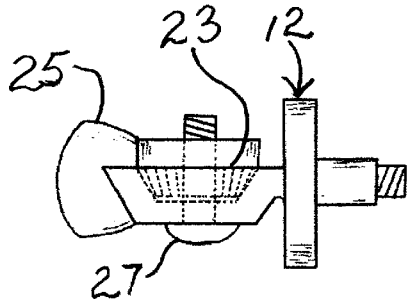
Figure 5:
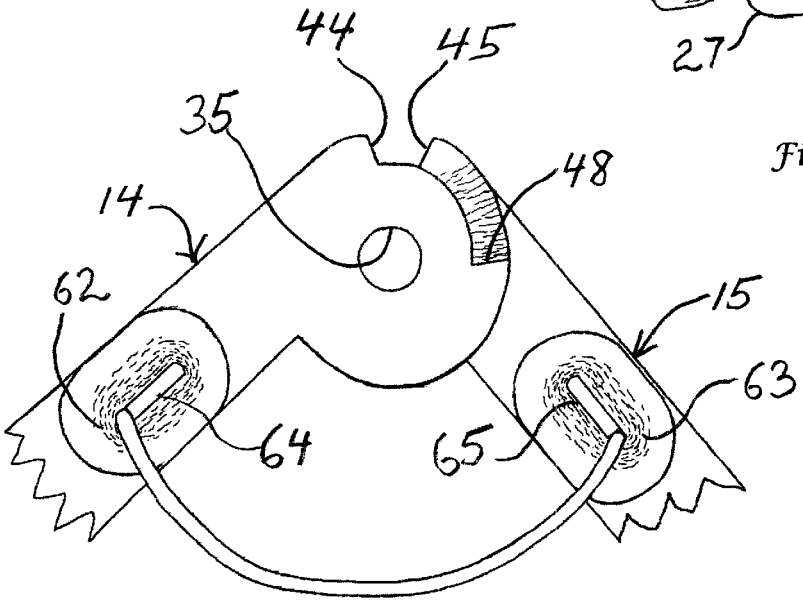
FIG. 5 is an elevational view of the FIG. 4 tool as viewed from its underside, except without the FIGS. 6 and 7 components.
Figure 9:
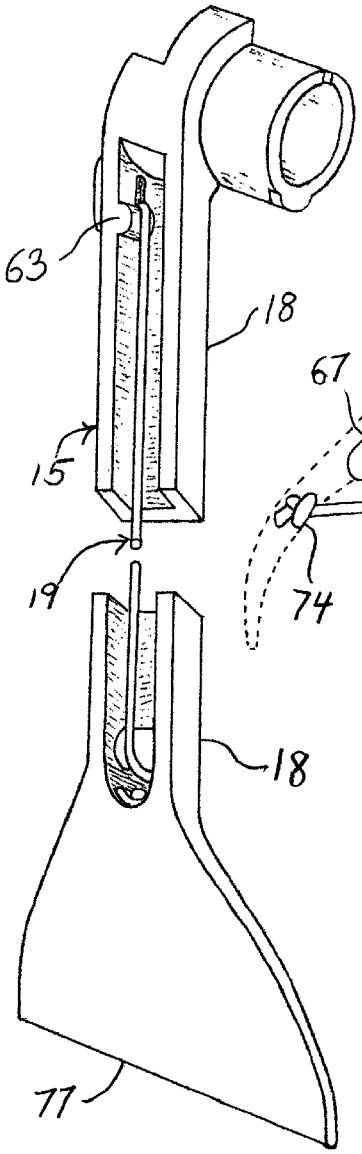
FIG. 9 is a perspective view of one of the tongs, as seen generally from a lateral side and showing a pull line in view.

A torsion spring 52 (see FIGS. 2, 4, 8, 10 and 11) connected between the tongs 14, 15 operates to rotatably bias them in the direction toward and/or to the opened position (FIG. 3). The spring 52 can be a single wire wound to have a medial coil having several turns and bent ends 54, 55. In the illustrated tool, tong 15 can have a cylindrical tube 57 projecting away from the mounting plate to underlie and support the medial spring coil; whereupon spring end 54 can fit into a slot in the tube 57 to interlock with tong 15 (FIGS. 8, 11) and spring end 55 can fit under and interlock with the tong 14 (FIGS. 3, 4, 11).

Figure 14:
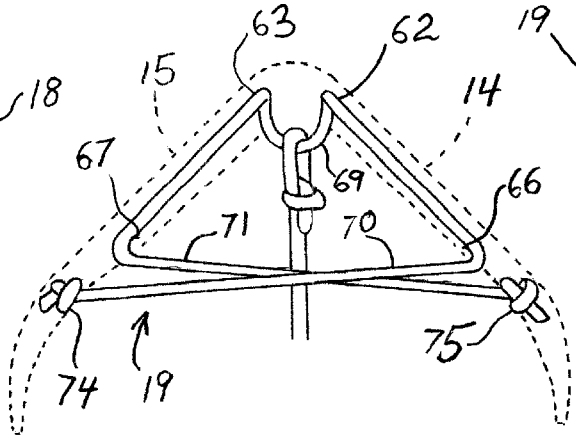
FIG. 14 is a schematic view of a pull line connected between the tongs and used for closing the tongs.

The pull line 19 (FIGS. 3, 14) is routed several times across the space between the tongs and around several redirection turns or corners before its ends are secured relative to the tongs. The redirection corners 62, 63 and 66, 67 respectively would be spaced apart along the tong arms, closely adjacent openings in the tongs; where corners 62, 63 would be close to but spaced from pivot structure 13 and corners 66, 67 would be spaced from the end scoops. The medial part of pull line 19 might be extended as crossing span 69 between the tongs, passing through the tong openings and around redirection turns 62, 63 to extend along each respective tong arm, and then over the redirection turns 66, 67 and through tong openings to crossing spans 70, 71 between the tongs, and through tong openings where the opposite line ends might be secured relative to the tongs, such as by making knots 74, 75 larger than the tong openings.

To reduce sharp bends in the line 19 as it navigates around the redirection corners 62, 63 and 66, 67, the tong openings might have raised rounded perimeter edges in the form of a bead or the like. Moreover, the tong opening 64, 65 could be elongated in the direction of the arm to allow the line, when tension has been removed from the line, to minimize line friction in passing around the corner only under the force of the spring 52. This would tend to compensate for the natural tendency of the relaxed line to become straight, which would direct the line against one of the channel walls of the tong arm for added drag.

Figure 2:
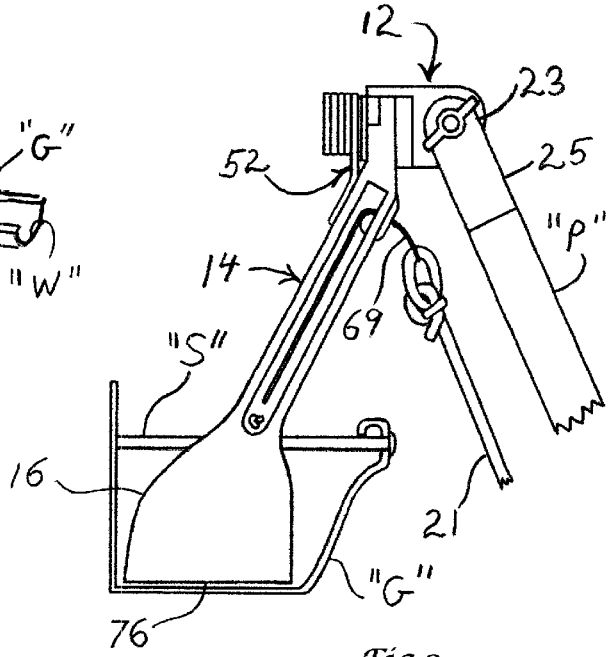
FIG. 2 is an enlarged side elevational view of the fully opened tool as viewed along the gutter from the left of FIG. 1.

The pull line 21 is looped around and knotted to connect it to pull line 19 at the crossing span 69, which being close to the tong pivots will clear the remote edge of the gutter (FIG. 2). On the other hand, the crossing spans 70, 71 are closer to the end scoops and are angled transverse to the tong arms (between possibly 45 and 90 degrees) to provide large pulling forces thereon for closing the tongs. The closing spans 70, 71 should be between about 2–4 inches from the end scoop edges to remain clear of or to ride over the gutter debris being collected.

Thus, tensioning the pull line 21 with forces sufficient to overcome the opening forces of the spring 52 will oscillate the tongs toward or to the closed position.

The pull line 19 might be comprised preferably of a monofilament or unidirectionally oriented plastic, such as nylon, which is strong, flexible, durable and of low coefficient of friction for easily sliding around the redirection corners when being tensioned or relaxed. The pull line 21 can be of flexible strong rope, such as of woven nylon.

A preferred embodiment provides that the rotational axis of the tongs, if extended, and the longitudinal axis of the mounting socket 25 and pole "P", if extended, would generally intersect one another. In the use of the tool illustrated in FIG. 2, these axes moreover would be angled transverse to one another. Also, the tongs 14, 15 are on the inboard end of the tool body 12 operatively adjacent the gutter; while the pole "P" and its mounting socket are on the outboard end of the tool body remote from the gutter.

Also, the tongs 14, 15 preferably are angled to diverge in an axial direction away from the mounting socket 25 by a small angle of perhaps 15–25 degrees from being perpendicular to the body pin axis (or rotational axis of the tongs). Further, the facing end scoops 16, 17 preferably would be slightly smaller than the width of the gutter bottom wall (see FIG. 2), with a flat bottom edges 76, 77 (see FIG. 2) preferably angled to be approximately parallel to the axis of gripper tong rotation (the same 15–25 degree of axial inclination of the tongs). This provides that the tong end edges will travel along a linear path as they are shifted between the opened and closed positions and will remain substantially flush against the bottom gutter wall throughout the closing stroke.

The inboardly and downwardly angled tool tongs 14, 15 further provide that the end scoops 16, 17 can be easily fitted into the upwardly open gutter "G", by the user "U" slightly rotating and lowering the pole "P" from below. The tongs oppose one another substantially over most of their lengths but specifically at the end scoops 16, 17, and in the closed position (see FIG. 8) the tong end edges 76, 77 are generally touching or closely proximate.

The illustrated tongs might be between ten and fifteen inches in length, meaning that the gutter cleaning stroke could be between fifteen and twenty plus inches. The tongs further preferably would be made of plastic to minimize having them scratch or otherwise damage the gutter "G". The tool body and tongs could economically be made by a conventional molding process. With nonconductive poles "P" of wood or plastic, the user should be protected against a safety risk of having the tool accidentally touch a live electric wire or the like.

One manner of operating the tool 10 might have the user "U" hold the pole "p" aligned generally upright, solidly with one hand and loosely with the other hand, and have the other hand also then firmly hold the pull line or rope 21. Thus, the other hand while yet stabilizing the pole can be shifted along the pole to adjust the tension on rope 21, for closing the tool tongs or for allowing the spring 52 to open the tool tongs.

Of particular importance, as the fully opened gripper tonas 14, 15 are held steady and centered relative to the pole "P", they can be lowered into and/or laterally shifted axially along the gutter until the outer or lateral side of one tong hits a gutter cross pin or strap "S". Both tongs can be lowered then against the bottom gutter wall "W" while still laterally holding the one tong laterally against that gutter strap. From this position, the tong diverging laterally at possibly between 35–45 degrees will underlie the strap, for effectively removing debris from under the strap. The user could easily detect if the medial side of a tong hit a cross strap (by the nature of the abrupt impact of the steadily hold opened tongs), and knowing this, the location of this strap would be noted and the tongs lifted from the gutter and replaced with the appropriate tong laterally adjacent the strap suited for closing the tongs.

Moreover, when the tongs are shifted from the fully opened position toward the closed position and are removed from contact against the centering stop, the tongs can be oscillated to different independent canted or non-centered angles relative to the pole "P". Nonetheless, the concentric rotation of both tongs about the body pin and the generally parallel alignment of the pin and tong end edges will tend to keep the closing and/or closed tongs exactly opposed to one another and solid against the gutter bottom wall, even when the tongs are rotated independently to different degrees of oscillation or inclination from the tool body and/or the pole, as typically will happen when the tool and/or the user might move lengthwise along the gutter.

Of further interest, the swivel connection 23 allows adjustment in the clockwise direction relative to FIG. 2 in excess of 180 degrees, so that the tongs then could be pointed and diverging in the direction away from the pole "P" and user "U" holding the pole. Also, the tong closing lines 19, 21 are effective in closing the tongs in this orientation (or any intermediate position of adjustment). The tool 10 thus can be used for other chores besides gutter cleaning, such as: picking items off of overhead shelves; picking up items at the remote end of a narrow passage (wells, sewers or ditches); and/or reaching horizontally with the pole to pick up items spaced but about at the same vertical position as the user (going over some object between the user and the item to be gripped, including with a modified tool, retrieving golf balls from a pond). This expanded scope of use could include cleaning gutters normally inaccessible from the ground, such as second floor gutters on dormers.

While a specific embodiment of the invention has been disclosed, minor variations might be made without varying from the overall inventive concept. Accordingly, the invention is to be limited only but by the scope of the following claims.

What is claimed as my invention is:

1. A tool comprising a body defining a longitudinal pivot axis;

means for mounting the body onto one end of a pole;

a pair of tongs and structure for mounting the tongs relative to the body for oscillation about the pivot axis between opened and closed positions;

the tongs being elongated in generally radial directions from the pivot axis to distal end scoops, and in the fully opened position, the tongs diverging to have the end scoops spaced part, and in the closed position, the tongs being in side-by-side alignment with the end scoops substantially touching;

means operable in the fully opened position to substantially center the pole between the diverging tongs and preclude tong oscillation relative to the body past the fully opened position;

a spring operable to bias the tongs to the opened position;

each tong also having two redirection means spaced apart along the tong and spaced from the pivot axis and the end scoop;

a flexible tong line having a fixed length and extended as spaced spans across the space between the tongs and each span overlying respective redirection means on the tongs to have the spans at different distances from the pivot axis; and a flexible pull line secured at one end onto the tong line span closer to the pivot axis and extended at its other end to proximity of the other pole end, operable upon being tensioned with forces that overcome the spring to oscillate the tongs toward or to the closed position.

2. A tool according to claim 1, further comprising said pole centering means being inoperable with the tong shifted from the fully opened position toward the closed position, so that said tongs can be oscillated independently to non-centered orientations relative to the body.

3. A tool according to claim 2, further comprising said pole centering means including stop means on the body and each tong having face means operable to engage said stop means in the fully opened position and to become separated from said stop means upon oscillation of the tong toward the closed position.

4. A tool according to claim 1, further comprising said tong line being formed of a monofilament or unidirectionally oriented plastic, and said flexible pull line being secured onto the tong line operable to slide freely along the closer span length between the tongs.

5. A tool for cleaning a gutter, comprising a body defining a longitudinal pivot axis and having opposing stop faces;

means for mounting the body onto one end of an extension pole having a longitudinal axis;

a pair of tongs and structure for mounting the tongs relative to the body for oscillation about the pivot axis between opened and closed positions;

the tongs being elongated in generally radial directions from the pivot axis to distal end scoops, and in the fully opened position, the tongs diverging to have the end scoops spaced apart, and in the closed position, the tongs being in side-by-side alignment with the end scoops substantially touching;

stop means on the tongs operable in the fully opened position to engage said body stop faces and substantially center the pole between the diverging tongs and preclude tong oscillation relative to the body past the fully opened position;

a spring operable to bias the tongs to the opened position;

each tong also having first and second redirection means spaced apart along the tong and respectively proximate but spaced from the pivot axis and the end scoop, with the first redirection means being closer to the pivot axis than the second redirection means;

a flexible tong line extended as a first span across the space between the tongs and overlying the first redirection means on each tong and extended along each respective tong to overlie the second redirection means on each tong and extended as second spans across the space between the tongs and secured at its opposite ends relative to the respective tongs at intermediate locations between the pivot axis and end scoops; and a flexible pull line secured onto the tong line at the first span and extended to proximity of the other pole end, operable upon being tensioned with forces that overcome the spring to oscillate the tongs toward or to the closed position.

6. A tool according to claim 5, further comprising said pivot and pole axes generally intersecting in one mode of use.

7. A tool according to claim 5, further comprising said tong stop means and said body stop faces being disengaged with the tong shifted from the fully opened position toward the closed position, so that said tongs can be oscillated independently to non-centered orientations relative to the body and said pole.

8. A tool according to claim 5, further comprising said elongated tongs lying between 15–25 degrees from a perpendicular alignment from the pivot axis, to provide that the distal end scoops are axially remote relative to said alignment from the means for mounting the extension pole and from said pole axis.

9. A tool according to claim 8, further comprising said end scoops having flat end edges angled to extend approximately parallel to the pivot axis.

10. A tool according to claim 9, further comprising said body consisting of two sections, where one section defines the longitudinal pivot axis and the other section defines the means for mounting the body on the extension pole, and means for connecting the sections together to have the pivot and pole axes adjustably held at different angles relative to one another suited to have the tong end scoops located and manipulated as needed during use.

11. A tool according to claim 10, further comprising said tong stop means and said body stop faces being disengaged with the tongs shifted from the fully opened position toward the closed position, so that said tongs can be oscillated independently to non-centered orientations relative to the body and said pole.

12. A tool according to claim 5, further comprising said tong line being formed of a monofilament or unidirectionally oriented plastic, and said flexible pull line being secured onto the tong line operable to slide freely along the first span length between the tongs.

* * * * *